United States Patent [19]

Ellingson, Jr.

[11] Patent Number: 4,766,020

[45] Date of Patent: Aug. 23, 1988

[54] UNITARY CONNECTING FLOOR MAT SECTIONS

[75] Inventor: Chester W. Ellingson, Jr., Burnsville, Minn.

[73] Assignee: Reese Enterprises, Inc., Rosemount, Minn.

[21] Appl. No.: 88,829

[22] Filed: Aug. 24, 1987

[51] Int. Cl.[4] ..... B32B 3/10

[52] U.S. Cl. ..... 428/54; 428/58; 428/60; 52/177; 404/41

[58] Field of Search ..... 428/53, 54, 60, 58, 428/61, 62; 52/177, 595; 15/215-217; 404/33, 41

[56] References Cited

U.S. PATENT DOCUMENTS

| | | | |
|---|---|---|---|
| Re. 32,061 | 1/1986 | Ellingson | 428/52 |
| 3,808,628 | 6/1974 | Betts | 15/215 |
| 4,029,834 | 6/1977 | Bartlett | 428/62 |
| 4,663,903 | 5/1987 | Ellingson | 52/181 |

*Primary Examiner*—Alexander S. Thomas

*Attorney, Agent, or Firm*—Leo Gregory

[57] ABSTRACT

A connecting structure of floor mat sections particularly adapted for public foyer walking areas, the connecting sections being formed to be unitary of plastic material, certain of said sections having terminal portions at each side thereof having axial bores therein coextensive therewith, said bores having slots therethrough at the outer side thereof and alternate of said sections having terminal portions at each side thereof having outwardly extending web portions having outer edges adapted to be received and retained within an adjacent of said bores for interconnection of said sections, said webs having medial thickness such as to pass through said slots, said sections having tread surfaces and underlying support surfaces, said surfaces being reversible.

5 Claims, 2 Drawing Sheets

UNITARY CONNECTING FLOOR MAT SECTIONS

BACKGROUND OF THE INVENTION

1. Field of Invention

This invention relates to interconnected floor mat sections of unitary construction for use in public walking areas.

2. Description of the Prior Art

Floor mat structures are in common use in public building walking areas and particularly in foyer areas of such buildings. Preferably mat structures are adapted to be rolled up for cleaning purposes.

It is a common practice to form the rails of floor mat sections of a rigid material such as of extruded aluminum and to provide upper portion recesses therein to receive the insertion of tread strips to form walking surfaces.

It is also a fairly common practice to provide auxiliary support to underlie the mat sections to cushion the noise from walking on the rigid rails and from their relative movement.

The following references appear to disclose the present practice in the art.

In U.S. Pat. No. 4,029,384 to G. H. Bartlett, spaced metal rails having tread inserts form the mat structure and the same are coupled by members having rotation therewith.

In U.S. Pat. No. 3,808,628 to Kenneth H. Betts, rigid floor sections have tread inserts and are joined by flexible strips having projecting portions disposed into and being retained in adjacent bores of adjacent rails.

In U.S. Pat. No. 4,654,245 issued to C. P. Balzer et al, there is disclosed a rigid rail having a tread insert and a coupling member having laterally disposed opposed T-members received in compatible bores of adjacent mat sections and having depending lateral flaps underlying and supporting adjacent mat sections.

In U.S. Pat. No. 4,675,222 to F. P. Berndt there is disclosed rail members having tread inserts and having coupling members having spaced upstanding T-connecting members disposed in compatible slots of adjacent rail members and having oppositely extending portions thereof underlying and supporting the adjacent rail members.

SUMMARY OF THE INVENTION

The invention herein relates to floor mat sections of unitary construction particularly arranged and interconnected to permit a roll up of the mat sections for clean up purposes.

As indicated in the reference material cited, it appears to be the general practice to form the rails of the mat sections of a rigid material such as of metal and to have inserted tread strips and auxiliary or supplementary underlying supports.

It is a particular object of the invention herein to provide a floor mat structure of unitary construction having an upfacing tread surface and an underlying supporting cushion portion and being particularly adapted to be interconnected.

It is a further object of the invention herein to provide floor mat sections whereby adjacent of said sections are adapted to be interconnected and such connections accommodate a roll up of the mat sections for cleaning purposes.

These and other objects and advantages of the invention will be set forth in the following description made in connection with the accompanying drawings in which like reference characters refer to similar parts throughout the several views.

BRIEF DESCRIPTION OF THE FIGS

DESCRIPTION OF A PREFERRED EMBODIMENT

Figure 1:
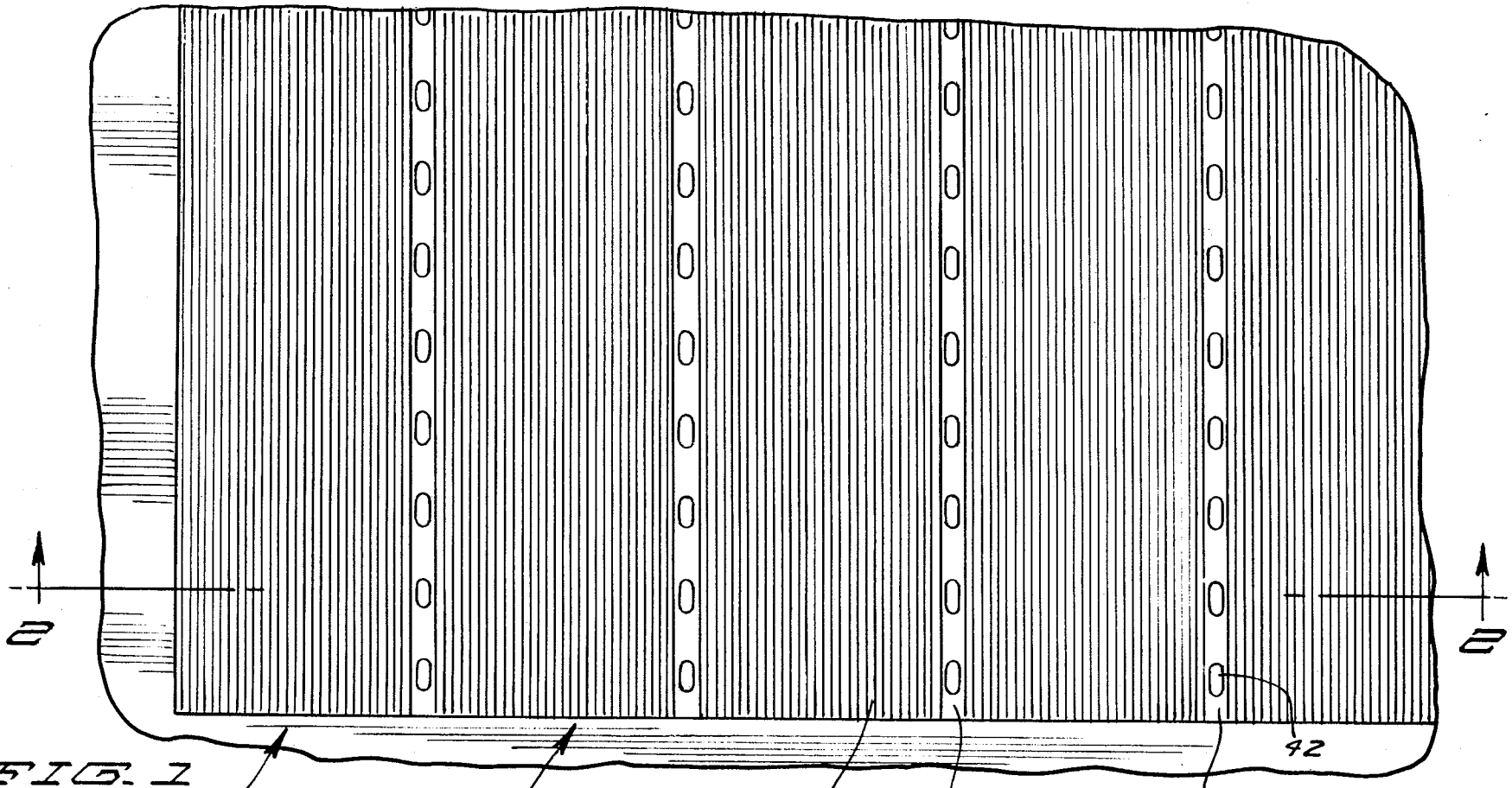
FIG. 1 is a broken view in plan.

Referring to the Figs., shown are floor mat structures 10 and 12 which are of like construction and alternate in becoming interconnected as will be described.

The mat structure 10 will first be described. The structure 10 is unitarily extruded preferably of a suitable plastic material and is described as comprising a basic body portion 14 having enlarged laterally spaced terminal portions 15 and 16 being on the order of shoulders and having longitudinal bores 17 and 18 respectively extending through said shoulders. Extending outwardly through the end walls **17*a* and 18*a* of said bores are slots 19 and 20** of a lesser height than the height of said bores.

Extending upwardly of said body portion 14 are spaced ribs 22 having therebetween slots 23. Spaced ribs **22*a* are also formed upstanding from said shoulders 15 and 16 but only of such a height as to be coplanar with said ribs 22**.

Thus said ribs 22 and **22*a* form a tread or walking surface 40**.

In the embodiment here shown, extending downwardly of said body portion 14 are ribs 26 and **26*a* which are the same as the described ribs 22 and 22*a* and form an underlying support surface 41 for said mat structure 10**.

Said mat structure 12 to the extent it is identical to the structure 10 has its like parts indicated by the same reference numbers with a prime added.

The lateral terminal portions or shoulders 31 and 32 of said member 12 are solid and extending laterally outwardly of each of said shoulders are webs 34 and 36 having enlarged terminal portions 35 and 37. Said terminal portions are adapted to be received within said bores 17 and 18 and to be retained therein; said webs respectively having medial portions **34*a* and 36*a* of a thickness that is less than the height of said slots 19 and 20 and said terminal portions 35 and 37** have a height greater than the height of said slots.

Thus it is seen that in a sequence of said mat structures 10, said mat structures 12 will be disposed as alternate mats to interconnect said mats 10.

Said webs 34 and 36 having openings 42 spaced therealong for dirt particles to fall through and these are picked up when the mat structure is rolled up for cleaning purposes. In addition some dirt particles will deposit and collect in the slots 23, 23'. Thus the walking surface of said mat structure is maintained in a clean condition. Said ribs 26 have slots 27 therebetween.

It is seen that the tread surface 40 and the mat supporting surface 41 may be reversed thus the top and bottom portion of each mat structure has equal utility.

Figure 2:
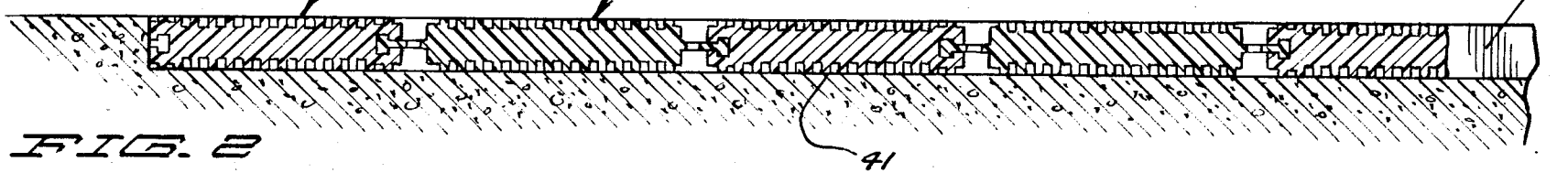
FIG. 2 is a view in vertical section taken on line 2—2 of FIG. 1, as indicated.
Figure 3:
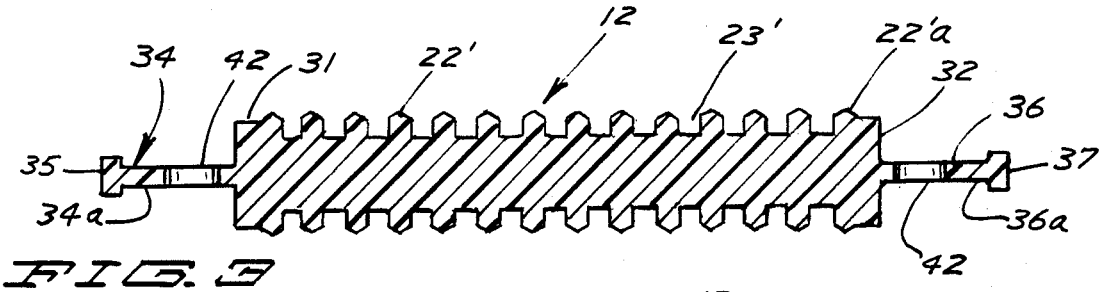
FIG. 3 is a view in vertical section.
Figure 4:
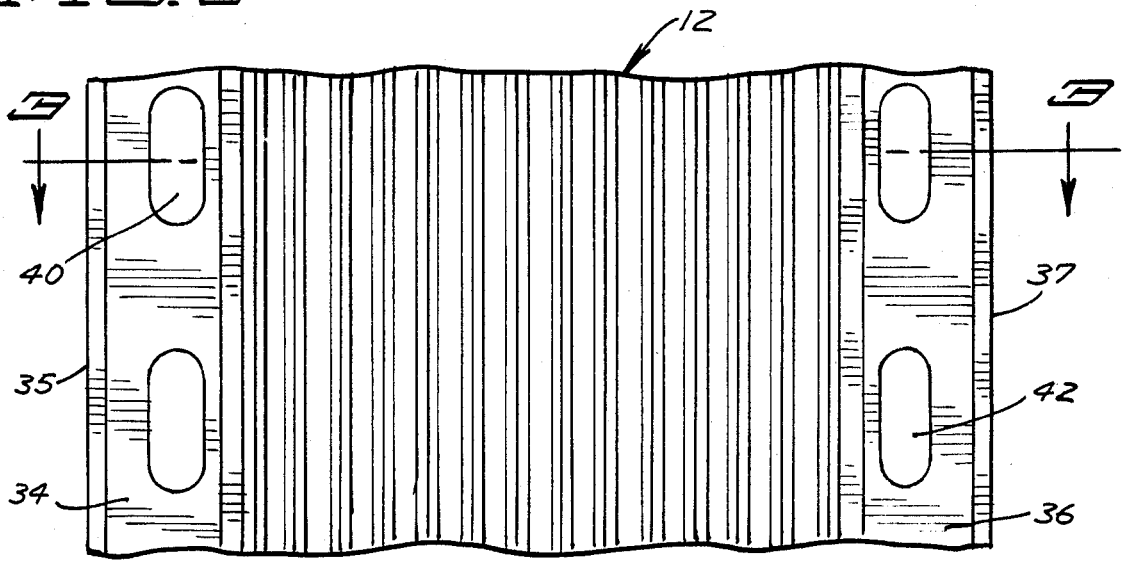
FIG. 4 is a broken view in plan.
Figure 5:
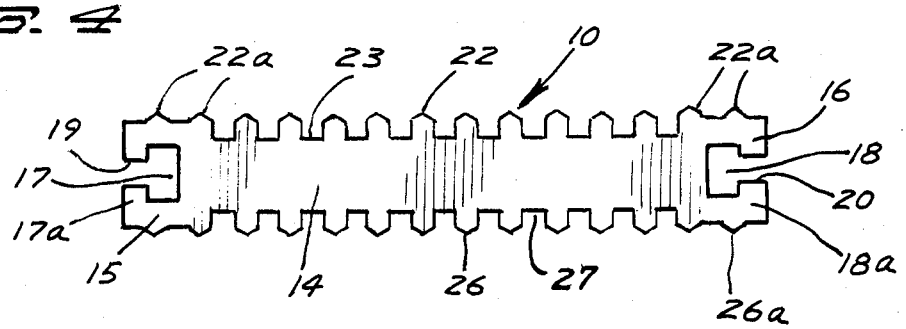
FIG. 5 is a view in end elevation showing an alternating form to that of the structure in FIG. 3.

FIG. 2 shows connected mat sections 12 and 14 installed in a recessed floor area 50. Installation may also be made on a planar surface with the outer ends of the end sections having tapered shoulders, the same not being here shown.

It will of course be understood that various changes may be made in the form, details, arrangement and proportions of the product without departing from the scope of applicant's invention which, generally stated, consists in a product capable of carrying out the objects above set forth, such as disclosed and defined in the appended claims.

What is claimed is:

1. A floor covering mat structure consisting of interconnected sections, having in combination a first section having a central body portion and unitary therewith lateral terminal body portions at each side thereof, all formed of a plastic material, said first section having a self formed ribbed tread surface, said lateral terminal portions each having an axial bore, a slot extending outwardly laterally of each of said bores, a second section having a central body portion and unitary therewith lateral terminal body portions at each side thereof, all formed of a plastic material, said second section having a self formed ribbed tread surface, said last mentioned lateral terminal portions each having a web extending outwardly laterally thereof, each of said webs having an outer edge portion disposed within the bore of an adjacent body lateral terminal portion and retained therein, each of said webs having a medial thickness such as to extend through the slot of the bore of an adjacent body terminal portion, and the underlying surface portions of said first and said second sections forming an underlying support.

2. A floor covering mat structure consisting of interconnected sections, having in combination an elongated body portion, a terminal portion at each side of said body portion unitary therewith, and said body and terminal portions being formed of a plastic material, an axial bore extending through each of said terminal portions, a slot extending outwardly laterally of each of said bores, a second elongated body portion, a terminal portion at each side of said second mentioned body portion unitary therewith and said body and terminal portions being formed of a plastic material, a web extending outwardly laterally of each of said second mentioned terminal portions, each of said webs having an outer edge compatible with and disposed within an adjacent of said bores and retained therein, each of said webs having a medial thickness such as to extend through an adjacent of said slots, said first and second mentioned body portions each having self formed upstanding ribbed tread surface portions, said body portions each having an underlying surface portion like its respective overlying tread surface portion, said underlying surface portions each forming an underlying support, and said underlying surface portions being interchangeable with said overlying tread surface portions.

3. The structure of claim 2, wherein said tread surface of each of said body portions extending upon their respective terminal portions.

4. The structure of claim 2, wherein said webs have spaced apertures therein of a size to permit particles of dirt to pass therethrough.

5. The structure of claim 2, wherein said ribbed tread surface comprises a multiplicity of closely spaced vertical fins.

* * * * *